US009322135B2

(12) United States Patent
Pietikäinen et al.

(10) Patent No.: US 9,322,135 B2
(45) Date of Patent: Apr. 26, 2016

(54) METHOD FOR PRODUCING FIBER WEBS AND PRODUCTION LINE FOR PRODUCING FIBER WEBS

(71) Applicants: Reijo Pietikäinen, Järvenpää (FI); Mika Viljanmaa, Helsinki (FI); Jari Ilomäki, Helsinki (FI); Seppo Luomi, Järvenpää (FI)

(72) Inventors: Reijo Pietikäinen, Järvenpää (FI); Mika Viljanmaa, Helsinki (FI); Jari Ilomäki, Helsinki (FI); Seppo Luomi, Järvenpää (FI)

(73) Assignee: Valmet Technologies, Inc., Espoo (FI)

( * ) Notice: Subject to any disclaimer, the term of this patent is extended or adjusted under 35 U.S.C. 154(b) by 0 days.

(21) Appl. No.: 14/548,717

(22) Filed: Nov. 20, 2014

(65) Prior Publication Data

US 2015/0136349 A1 May 21, 2015

(30) Foreign Application Priority Data

Nov. 21, 2013 (EP) ..... 13193865

(51) Int. Cl.
*D21G 1/00* (2006.01)
*D21H 25/04* (2006.01)
(Continued)

(52) U.S. Cl.
CPC ..... *D21H 25/005* (2013.01); *D21F 9/00* (2013.01); *D21G 1/006* (2013.01); *D21H 25/04* (2013.01); *D21H 25/14* (2013.01)

(58) Field of Classification Search
CPC ..... D21G 7/00; D21G 1/006; D21G 1/0093; D21G 9/0036; D21G 1/00; D21G 1/0066; D21G 1/02; D21G 1/0266; D21F 7/003; D21F 9/00; D21F 5/187; D21F 5/188; D21H 25/14; D21H 25/005; D21H 25/04; D21H 23/50
See application file for complete search history.

(56) References Cited

U.S. PATENT DOCUMENTS 3,838,000 A * 9/1974 Urbas ..... D21G 7/00 162/207
3,864,842 A * 2/1975 Sawyer ..... D21G 9/0036 162/252

(Continued)

FOREIGN PATENT DOCUMENTS

DE 102005053968 A1 5/2007
EP 1196249 B1 4/2002

(Continued)

OTHER PUBLICATIONS

European Search Report for EP 13193865 dated Jan. 4, 2014.

(Continued)

*Primary Examiner* — Jose Fortuna
(74) *Attorney, Agent, or Firm* — Stiennon & Stiennon

(57) ABSTRACT

A method for producing a fiber web (W) in which method the fiber web (W) is calendered in at least one nip (NA) of a calender (20A). The fiber web (W) is cooled at least partially by moisturizing evaporating cooling by a moisturizing evaporating cooling unit (10) before the fiber web is calendered and moisture is absorbed during 10-500 ms. A production line for producing fiber webs (W) has a calender (20A) with a calendering nip (NA). The production line for fiber webs, in particular board webs, has a fiber web machine (50), in particular a board machine, with a head box, a wire section, a press section and a drying section, and at least one moisturizing evaporating cooling module (10), and a hard nip calender (20A) with a thermo roll, which has a surface temperature at least 120° C., and a reel-up (40).

19 Claims, 4 Drawing Sheets

(51) Int. Cl.

| | |
|---|---|
| ***D21F 9/00*** | (2006.01) |
| ***D21H 25/00*** | (2006.01) |
| ***D21H 25/14*** | (2006.01) |

(56) References Cited

U.S. PATENT DOCUMENTS

| | | | | | |
|---|---|---|---|---|---|
| 4,274,210 | A * | 6/1981 | Stengard | B65H 23/24 | 226/196.1 |
| 4,646,540 | A | 3/1987 | Blackwood et al. | | |
| 4,689,895 | A * | 9/1987 | Taylor | D21F 7/003 | 34/114 |
| 4,702,015 | A * | 10/1987 | Taylor | D21F 7/003 | 34/114 |
| 4,738,197 | A | 4/1988 | Mälkiä | | |
| 4,763,424 | A * | 8/1988 | Taylor | D21F 7/003 | 34/114 |
| 5,045,342 | A | 9/1991 | Boissevain et al. | | |
| 5,331,749 | A * | 7/1994 | Thiele | D21F 5/042 | 34/117 |
| 5,377,428 | A * | 1/1995 | Clark | D21F 5/00 | 34/116 |
| 5,471,847 | A * | 12/1995 | Murray | B41F 23/0476 | 100/332 |
| 5,778,559 | A * | 7/1998 | Winheim | D21G 7/00 | 162/202 |
| 6,142,391 | A * | 11/2000 | Seyed-Yagoobi | B05B 1/005 | 239/518 |
| 6,207,020 | B1 | 3/2001 | Anderson | | |
| 6,613,195 | B2 * | 9/2003 | Anderson | D21G 7/00 | 162/289 |
| 6,886,455 | B2 * | 5/2005 | Pietikainen | D21G 1/00 | 100/35 |
| 7,429,311 | B2 * | 9/2008 | Pietikainen | D21G 7/00 | 118/325 |
| 8,486,229 | B2 * | 7/2013 | Pietikainen | D21F 5/004 | 162/280 |
| 2001/0008181 | A1 * | 7/2001 | Anderson | D21G 7/00 | 162/204 |
| 2003/0219538 | A1 * | 11/2003 | Vahakuopus | B05B 13/0207 | 427/348 |
| 2006/0060322 | A1 * | 3/2006 | Viljanmaa | D21F 3/0209 | 162/206 |
| 2006/0276317 | A1 * | 12/2006 | Pietikainen | D21G 1/02 | 492/59 |
| 2008/0289784 | A1 * | 11/2008 | Pietikainen | D21G 1/0066 | 162/135 |
| 2015/0136349 | A1 * | 5/2015 | Pietikainen | D21H 25/04 | 162/206 |

FOREIGN PATENT DOCUMENTS

| | | | | |
|---|---|---|---|---|
| EP | 1425469 | B1 | 6/2004 | |
| EP | 2220293 | B1 | 8/2010 | |
| EP | 13193865 | | 11/2013 | |
| FI | EP 2682520 | A1 * | 1/2014 | D21G 1/0093 |
| FI | EP 2876206 | A1 * | 5/2015 | D21H 25/04 |
| WO | 0017446 | A1 | 3/2000 | |
| WO | 0052266 | A1 | 9/2000 | |
| WO | 0151709 | A1 | 7/2001 | |

OTHER PUBLICATIONS

V. Narayanan, "Oscillatory Thermal Structures in a Reattaching Jet Flow", Journal of Visualization, vol. 10, No. 4 (2007)389-396.

* cited by examiner 10
14
14
W
S 10
14
13
14
13
14
12
12
11
11
L
10
14
13
14
14
12
11
W
S

METHOD FOR PRODUCING FIBER WEBS AND PRODUCTION LINE FOR PRODUCING FIBER WEBS

CROSS REFERENCES TO RELATED APPLICATIONS

This application claims priority on European Application No. EP13193865, filed Nov. 21, 2013, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

In general, the present invention relates to producing fiber webs in a fiber web production line, in particular to producing board webs. More especially the present invention relates to a method of cooling a fiber web by evaporated the water over a time period of 10-5000 ms followed by calendering and to a production line for fiber webs in particular a board machine, having at least one moisturizing evaporating cooling module and a hard nip calender with a thermo roll, which has a surface temperature of at least 100 degrees C.

As known from the prior art, fiber web producing processes typically comprise an assembly formed by a number of apparatuses arranged consecutively in the process line. A typical production and treatment line comprises a head box, a wire section and a press section as well as a subsequent drying section and a reel-up. The production and treatment line can further comprise other devices and/or sections for finishing the fiber web, for example, a pre-calender, a sizer, a final-calender, a coating section. The production and treatment line also comprises at least one slitter-winder for forming customer rolls as well as a roll packaging apparatus. In this description and the following claims by fiber webs are meant for example paper and board webs.

Calendering can be pre-calendering or final calendering depending on the type of the production line. Pre-calendering is typically used for creating required surface properties for further treatment for example for coating and final calendering is generally carried out in order to improve the properties, like smoothness and gloss, of a web-like material such as a paper or board web. In calendering the web is passed into a nip, i.e. a calendering nip, formed between rolls that are pressed against each other, in which nip the web becomes deformed as by the action of temperature, moisture and nip pressure. In the calender the nips are formed between a smooth-surfaced press roll such as a metal roll and a roll coated with resilient material such as a polymer roll or between two smooth-surfaced rolls. The resilient-surfaced roll adjusts itself to the forms of the web surface and presses the opposite side of the web evenly against the smooth-surfaced press roll. The nips can be formed also by using instead one of a roll, a belt, or a shoe as known from the prior art. Many different kinds of calenders to be used as a pre-calender and/or as a final-calender are known, for example hard nip calenders, soft nip calenders, supercalenders, metal belt calenders, shoe calenders, long nip calenders, multi-nip calenders, etc. Paper and board are available in a wide variety of types and can be divided according to basis weight into two grades: papers with a single ply and a basis weight of 25-300 g/m$^2$ and boards manufactured in multi-ply technology and having a basis weight of 150-600 g/m$^2$. It should be noted that the borderline between paper and board is flexible since the board grades with the lightest basis weights are lighter than the heaviest paper grades. Generally speaking, paper is used for printing and board for packaging.

The subsequent descriptions are examples of values presently applied for fibrous webs, and there may be considerable fluctuations from the disclosed values. The descriptions are mainly based on the source publication *Papermaking Science and Technology*, section Papermaking Part 3, edited by Rautiainen, P., and published by Paper Engineers' Association, Helsinki 2009; 404 pages.

Mechanical-pulp based, i.e. wood-containing printing papers, include newsprint, uncoated magazine and coated magazine paper.

Today's newsprint furnishes mostly contain between 80 and 100% deinked pulp (DIP). The rest of the furnish is mechanical pulp (typically TMP). However, there is also newsprint made of 100% mechanical fiber furnishes. DIP based newsprint may contain up to 20% filler. The filler content of a virgin-fiber based newsprint furnish is about 8%.

General values for CSWO newsprint can be regarded as follows: basis weight 40-48.8 g/m$^2$, PPS S10 roughness (SCAN-P 76-95) 4.0-4.5 μm, Bendtsen roughness (SCAN-P21:67) 150 ml/min, density 600-750 kg/m3, brightness (ISO 2470:1999) 58-59%, and opacity (ISO 2470:1998) 92-95%.

Uncoated magazine paper (SC-supercalendered) grades usually contain 50-75% mechanical pulp, 5-25% chemical pulp, and 10-35% filler. The paper may also contain DIP. Typical values for calendered SC paper (containing e.g. SC-C, SC-B, and SC-A/A+) include basis weight 40-60 g/m$^2$, ash content (SCAN-P 5:63) 0-35%, Hunter gloss (ISO/DIS 8254/1)<20-50%, PPS S10 roughness (SCAN-P 76:95) 1.0-2.5 μm, density 700-1250 kg/m', brightness (ISO 2470:1999) 62-75%, and opacity (ISO 2470:1998) 90-95%.

Coated mechanical papers include for example MFC (machine finished coated), LWC (light weight coated), MWC (medium weight coated), and HWC (heavy weight coated) grades. Coated mechanical papers usually contain 45-75% mechanical or recycled fiber and 25-55% chemical pulp. Semichemical pulps are typical in LWC paper grades made in the Far East. The filler content is about 5-10%. The grammage is typically in the range 40-80 g/m$^2$.

General values for LWC paper can be regarded as follows: basis weight 40-70 g/m$^2$, Hunter gloss 50-65%, PPS S10 roughness 1.0-1.5 μm (offset) and 0.6-1.0 μm (roto), density 1100-1250 kg/m$^3$, brightness 70-75%, and opacity 89-94%.

General values for MFC paper (machine finished coated) can be regarded as follows: basis weight 48-70 g/m$^2$, Hunter gloss 25-40%, PPS S10 roughness 2.2-2.8 μm, density 900-950 kg/m$^3$, brightness 70-75%, and opacity 91-95%.

General values for MWC paper (medium weight coated) can be regarded as follows: basis weight 70-90 g/m$^2$, Hunter gloss 65-70%, PPS S10 roughness 0.6-1.0 μm, density 1150-1250 kg/m$^3$, brightness 70-75%, and opacity 89-94%.

Woodfree paper is divided into two segments: uncoated and coated. Conventionally, the furnish of woodfree papers consists of bleached chemical pulp, with less than 10% mechanical pulp.

Typical values are for uncoated WFU Copy paper: grammage 70-80 g/m$^2$, Bendtsen roughness 150-250 ml/min and bulk >1.3 cm$^3$/g; for uncoated offset paper: grammage 60-240 g/m$^2$, Bendtsen roughness 100-200 ml/min and bulk 1.2-1.3 cm$^3$/g; and for color copy paper: grammage 100 g/m$^2$, Bendtsen roughness <50 ml/min and bulk 1.1 cm$^3$/g.

In coated pulp-based printing papers (WFC), the amounts of coating vary widely in accordance with requirements and intended application. The following are typical values for once- and twice-coated, pulp-based printing paper: once-coated basis weight 90 g/m$^2$, Hunter gloss 65-80%, PPS S10 roughness 0.75-1.1 μm, brightness 80-88%, and opacity 91-94%, and twice-coated basis weight 130 g/m$^2$, Hunter gloss 70-80%, PPS S10 roughness 0.65-0.95 μm, brightness 83-90%, and opacity 95-97%. Containerboard includes both linerboard and corrugating medium. Liners are divided according to their furnish base into kraftliner, recycled liner and white top liner. Liners are typically 1- to 3-ply boards with grammages varying in the range 100-300 g/m$^2$.

Linerboards are generally uncoated, but the production of coated white-top liner is increasing to meet higher demands for printability.

The main cartonboard grades are folding boxboard (FBB), white-lined chipboard (WLC), solid bleached board (SBS) and liquid packaging board (LPB). In general, these grades are typically used for different kinds of packaging of consumer goods. Carton board grades vary from one-up to five-ply boards (150-400 g/m$^2$). The top side is usually coated with from one to three layers (20-40 g/m$^2$), the back side has less coating or no coating at all. There is a wide range of different quality data for the same board grade. FBB has the highest bulk thanks to the mechanical or chemimechanical pulp used in the middle layer of the base board. The middle layer of WLC consists mainly of recycled fiber, whereas SBS is made from chemical pulp, exclusively.

FBB's bulk typically is between 1.1-1.9 cm$^3$/g whereas WLC is on range 1.1-1.6 cm$^3$/g and SBS 0.95-1.3 cm$^3$/g. The PPS-s10-smoothness is respectively for FBB between 0.8-2.1 μm, for WLC 1.3-4.5 μm and for SBS 0.7-2.1 μm.

Release paper is used in label base paper in various end-use applications, such as food packaging and office labels. The most common release paper in Europe is supercalendered glassine paper coated with silicone to provide good release properties.

Typical values for supercalendered release papers are basis weight 60-95 g/m$^2$, caliper 55-79 μm, IGT 12-15 cm, Cobb Unger for dense side 0.9-1.6 g/m$^2$ and for open side 1.2-2.5 g/m$^2$.

Coated label paper is used as face paper for release, but also for coated backing paper and flexible packing. Coated label paper has a grammage of 60-120 g/m$^2$ and is typically sized or precoated with a sizer and single-blade coated on one side. Some typical paper properties for coated and calendered label paper are basis weight 50-100 g/m$^2$, Hunter gloss 70-85%, PPS S10 roughness 0.6-1.0 μm, Bekk smoothness 1500-2000 s and caliper 45-90 μm.

In U.S. Pat. No. 4,738,197 is disclosed a method for accomplishing smoothness and glaze to paper of board webs in a calender by leading a web through hot nips which are formed between cooperating rolls of different hardness and having adjustable temperatures. In this prior art method for gradient calendering the temperature of the web is arranged to be cooled before the web enters the hot nip in order to increase the efficiency of the gradient calendering. As suitable temperatures of the web this prior art discloses temperatures not higher than 70° C., favorably not higher than 50° C. such that the temperature difference in the nip between the web and the rolls is at least 30° C.

One problem with calendering of fiber webs is to achieve required surface properties and simultaneously achieve required bulkiness i.e. relation of thickness of the web to its grammage (basis weight). When the fiber web has high bulkiness the basis weight can be reduced which results as considerable savings in raw material. Thus in recent times it has been one of the main focus points in developing calenders, mostly due to environmental and cost saving reasons.

Typically the fiber web is guided from the drying section to a precalender, when the temperature of the fiber web is about 80-90° C. In the thickness direction of the web the middle layers of the web are hot and near plastic state, whereby during calendering the fiber web will compact also in the middle layers, which leads to bulk loss.

It is known from prior art that bulkiness can be saved in calendering by cooling the fiber web before calendering, for example decreasing the temperature of middle layers of the fiber web by 10° C. For example in DE 102005053968 is disclosed a method and an arrangement for calendering a paper, board or corresponding fiber web, in which the fiber web is guided through at least one heated calendering nip, where before the heated calendering nip the fiber web is guided via at least one cooling device. In this known method and arrangement the fiber web is cooled such that at least 50% of its thickness is under temperature of 30° C. and advantageously to even lower temperatures, even such that the fiber web is cooled to −10° C.

In U.S. Pat. No. 6,207,020 is disclosed a method for conditioning fibrous webs such as paper and paperboard webs on a papermaking machine, in which after the web is dried to improve the properties of the web a moving fiber web is conditioned after the drying by applying a flow of moistened gas prior to a calendering unit or prior to a steaming unit placed between the nozzles and the calender unit to cool the web and/or increase its moisture content in order to achieve improved properties including less moisture streaking, enhanced smoothness and avoidance of optical property loss.

Known from the prior art are various methods for making a fiber web as well as various concepts for making a fiber web, especially board web. The surface of the board web becomes smooth in Yankee drying. The smooth surface is suitable for coating, especially by blade coating, since when the surface is smooth less coating color is needed. Yankee cylinder has been a problem in making board due to its limited drying capacity, which limits the speed of the board machine. Thus replacing alternatives have been sought and one alternative is disclosed in EP patent publication 1425469, in which a method and such a concept for making a fiber web, especially board web, is described wherein no Yankee cylinder is needed. In this known alternative long-nip calendering is utilized, which can be based on use of shoe-press technology or thermo roll/belt technology. In shoe calendering the known shoe press technology is utilized in precalendering, wherein the shoe roll includes a shoe, loading elements, a lubrication oil system and a belt. The thermo roll is technology known from soft calendering and it can be a roll heated by water, steam, oil or induction. In belt calendering again a water, steam, oil or induction heated roll is used as well as belt circulation and a backing roll, which may be either a hard roll or a soft roll. The belt circulates by way of the backing roll and guiding/tensioning rolls, and the simple structure of the belt circulation also allows modernizing of old machine calendars and soft calendars for use in belt calendering. In this known method and concept according to EP 1425469 for making a fiber web, especially a board web, two calendering steps are used: precalendering by a long-nip calender and the actual calendering by a profiling calender, for example, either a soft calender or a hard nip calender (machine calender). The production line first includes a long-nip calender functioning as a pre-calender, whereupon surface sizing of the fiber web is performed, thereafter drying of the fiber web and calendering with a profiling calender and then coating.

It is also known from the prior art to replace the Yankee cylinder in board production lines by a metal belt calender, which also produces a smooth surface suitable for coating, which is applicable in higher speeds than the Yankee cylinder, by which good bulkiness at the same smoothness level is achieved and which is compact and thus provides the possibility of a shorter production line. As a calender, the metal belt calender is more complicated than, for example, a machine or a shoe calender, and thus a need for a simple, cost effective and raw material saving production line and for a method of producing board webs with high production capacity exists.

SUMMARY OF THE INVENTION

An object of the invention is to create a production line which is simple, cost effective and raw material saving, and a method of producing board webs with high production capacity. A further object of the present invention is to approach the above problems from a new point of view and to suggest novel solutions contrary to conventional modes of thinking.

To achieve the objects mentioned above and later the method according to the invention is mainly cooling the fiber web, at least partially, by evaporating the water over a time period of 10-5000 ms followed by calendering a fiber web in at least one calendering nip of a calender using a production line for fiber webs in particular a board machine, having at least one moisturizing evaporating cooling module and, a hard nip calender with a thermo roll, which has a surface temperature of at least 100° C.

Advantageously according to the invention a fiber web is cooled at least partially by moisturizing and evaporative cooling process, advantageously by a combination of applying moisture, for example water, and of blowing dry cool gas, for example air, onto the surface of the fiber web. The moisture evaporates and cools the fiber web. According to an advantageous feature the time delays between the moisture applying and the gas blowing are 10-500 ms. Using controlled amounts of water and a short absorption time, preferably the before said 10-500 ms, water penetration is restricted to a surface layer and evaporation is therefore efficient and rapid. The moisturizing evaporation cooling is advantageously done 10 ms-5000 ms before the fiber web is calendered.

The applicant has surprisingly noticed that the moisturizing of a hot web surface can be used to cool the fiber web very effectively—much more than assumed before. Adding of liquid, for example water onto the hot or sufficiently warm web surface leads to strong evaporation and cooling during which fiber web is cooled by evaporative cooling principle. The cooling is based on the fact that the latent heat, that is the amount of heat needed to evaporate liquid, for example water, is drawn from the fiber web. The evaporative cooling maintains the fiber web surface temperature at the wet-bulb temperature (WBT), which is in practice around 10-30° C., depending on the temperature and humidity in the ambient air near the fiber web. This sets the theoretical minimum level for the evaporative cooling and provides for the evaporative cooling to reach low web temperatures in cooling applications.

An advantageously large difference between the WBT (which is around 10-30° C.) and the actual temperature of the fiber web to be cooled (which typically is about 55-95° C.) is used, advantageously the difference is 25-85° C. and thus very effective evaporative cooling is achieved. The bigger the difference, the faster the cooling. The biggest potential can be achieved, particularly when the air near the web can be maintained in a dry and cool condition, for example by using ventilation. In addition, due to liquid's, for example water's high latent heat of evaporation (about 2250 J/g), the evaporative cooling can be supplied with a reasonable amount of added liquid. Due to the effective and the deep cooling effect of the moisturizing evaporating cooling, good smoothness and bulk saving is achieved in hot calendering.

The fiber webs comprise lignin, hemicellulose and cellulose and the functional properties of the fiber webs depend on the quantity relations of these components, which also has an effect to the glass transition temperature $T_g$ of the fiber web. In the method according to the invention the surface of the fiber web is cooled by the moisturizing evaporating cooling and then heated in the calender such that the $T_g$-temperature is exceeded only at surface layers. The middle layers of the fiber web are cooled by the moisturizing evaporating cooling such that temperature in the middle layers remains under the $T_g$-temperature and the material properties of the middle layers of the fiber web remain at elastic values.

According to advantageous embodiments of the invention, the production line for fiber webs, in particular for board webs, comprises a fiber web machine, in particular a board machine, which comprises a head box, a wire section, a press section and a drying section, and cooling at least partially by a moisturizing evaporating cooling unit, a hard nip calender with a thermo roll, which has a surface temperature of at least 100° C., advantageously at least 150° C. When producing coated fiber webs the production line further comprises a first coating unit, which is a blade or a curtain coating unit, a second coating unit, which is a curtain or a blade coating unit, advantageously a third coating unit, which is a blade coating unit and a reel-up. The production line can further comprise at least one slitter-winder and a packaging section.

According to an advantageous feature the cooling by at least partially by moisturizing evaporating cooling unit is located at a position where the temperature of the web is still high after the drying section, the temperature of the web is at least 55° C., advantageously at least 65° C., when the moisturizing evaporating cooling is started.

By the production line according to the invention, for example a production line without a Yankee cylinder can be realized, and thus achieving higher production speed and at least the same quality level of product with bulk savings is possible.

The production line according to the invention can also replace in pre-calender position used metal belt calender with a hard nip calender thus creating a simpler, cheaper production line with lower investment cost, which line is also easier to use but is at least as good quality level as well as bulk savings are achievable.

In the method according to the invention the fiber web, in particular the board web, is cooled by at least partially by moisturizing evaporating cooling after drying in the drying section and before calendering in the hard nip calender by evaporating at least 1-20 g/m$^2$ water per side of the fiber web. Advantageously the temperature of the fiber web is at least 55° C., advantageously at least 65° C., when the moisturizing evaporating cooling is started.

According to an advantageous feature of the invention the moisture content of the fiber web before the cooling at least partially by moisturizing evaporating cooling is 5-15% and after the cooling by at least partially by moisturizing evaporating cooling is 5-15% and thus it should be noted that the cooling at least partially by moisturizing evaporating cooling does not necessarily have an effect to the moisture content of the fiber web before and after the cooling by at least partially by moisturizing evaporating cooling; variation being only about +/−2%.

According to an advantageous feature of the invention the fiber web is moisturized by applying 1-25 g/m$^2$ water onto the fiber web per side, advantageously 5-20 g/m$^2$ water onto the fiber web per side.

According to an advantageous feature of the invention in cases where the dimensional changes or other changes in the properties of the fiber web are not desired the fiber web surface that is moisturized is poorly absorbent of moisture, for example Cobb water absorbency 60 s measured value being under 40 g/m$^2$, advantageously being under 20 g/m$^2$. This ensures that not all moisture is absorbed in the web structure but instead overflows and creates a moisture film at the surface, which gives time for evaporation such that the fiber web is not wetted too much. The film stays on the fiber web until the moisture is evaporated.

According to an advantageous feature of the invention in cases where dimensional changes or changes in other properties are desired, the moisturizing evaporating cooling is arranged such that the moisture absorption into the fiber web is provided.

By the invention several advantages are achieved: the bulkiness of the fiber web is higher which leads to savings in raw stock and thus also to environmental benefits. This is achieved due to calendering in low temperatures when the calendering effect is focused to the surface of the fiber web and thus the middle layer of the web is under reduced calendering effect which leads to higher bulkiness after calendering.

According to an advantageous feature the production line for fiber webs comprises at least one moisturizing evaporating cooling module, which comprises advantageously at least one cross directional liquid nozzle row for applying liquid, advantageously water, onto the moving fiber web, for example based on a pressure atomizing or gas atomizing nozzle technique, at least one cross directional gas nozzle row, for example based on a flotation or impingement nozzle technique, for blowing a gas, advantageously air, flow towards the moving fiber web and advantageously at least one cross directional suction opening for removing evaporating substances, advantageously water vapor, moist air and mist, from the close vicinity of the surface of the moving fiber web. The moisturizing evaporating cooling module also comprises inlet channels for gas and liquid and outlet channels for removing the by the suction opening removed water vapor and moist air. The moisturizing evaporating cooling module also comprises or is connected to actuators, for example blowers or pumps, in order to create inlet flows of the liquid nozzles and of the gas nozzles and to create suction and/or outlet flows of the gas and moisture to be removed. By cross directional is meant in a cross direction relating to the main running direction of the fiber web.

Advantageously the moisturizing evaporating cooling module has in the running direction of the fiber web alternately in cross directional rows liquid nozzles and gas nozzles such that liquid and gas is dosed in small dosages alternately so that the liquid on the surface of the fiber web is dried by the gas dosage before the next liquid dosage and thus prevents the liquid to absorb into the fiber web. More advantageously the liquid nozzle rows are located near the suction openings to improve the evaporated substance removal such that no dripping occurs.

Advantageously the moisturizing evaporating cooling module forms one structural unit that is independently mountable and compact. Advantageously an outer surface length of the moisturizing evaporating cooling module is 1-6 m in the running direction of the fiber web. Advantageously, the cooling effect is enhanced by using two sided cooling by arranging at least one moisturizing evaporating cooling module on each side of the paper web, preferably on the opposite sides at the same location in machine direction. By using a two sided cooling arrangement, the cooling rate is nearly doubled, particularly at heavy basis weight boards. Advantageously the moisturizing evaporating cooling module comprises several moisturizing evaporating cooling zones each comprising at least one liquid nozzle row and/or at least one gas nozzle row and optionally at least one cross directional suction opening.

According to one advantageous feature as moisturizing nozzle a non-atomizing nozzle is used as the liquid nozzle, especially when the moisturizing evaporating cooling is used for fiber web grades that have low absorbency of water. Also other non-contacting types of liquid nozzles or liquid applicators are suitable for the liquid nozzles of the moisturizing evaporating cooling module, especially types that are suitable for application of large amounts of moisture. The effective distance between the nozzle jets is for example 5 mm so that a continuous, very thin and smooth moisture film is created on the fiber web.

For example a nozzle type marketed under the trademark MicroJet and disclosed in patent publication EP 1196249 is advantageous nozzle type of the moisture applicator of the moisturizing evaporating cooling module especially in moisturizing evaporating cooling module positions where the moisture is transferred onto the fiber web by gravity or by using a very small pressure only.

In embodiments of the invention where a MicroJet type nozzle is used, an advantageous position for the moisture application is immediately before run of the fiber web where the moisture is evaporated for example by blow nozzles or air borne dryers. According to an advantageous feature of the invention the production line for fiber webs comprises a hard nip calender comprising a heated steel thermo roll. More advantageously the thermo roll is a heated shrink fitted sleeve roll comprising a cylindrical inner shaft for carrying a load, a metallic outer layer surrounding the inner shaft and flow channels for a heat-transfer agent, arranged in connection with an interface of the inner shaft and the outer layer, and the thermo roll being manufactured by assembling the inner shaft and the outer layer, and the flow channels of the thermo roll consisting of flow grooves formed before the assembly of the inner shaft and the outer layer on an outer surface of the inner shaft and/or an inner surface of the outer layer, in which the outer layer is fastened to the inner shaft with shrink fitting, for example a roll type that is disclosed in EP-publication 2220293. According to an advantageous embodiment of the invention in the calender of the production line at least the first roll that the incoming fiber web contacts is a heated, steel thermo roll, advantageously a heated, shrink fitted sleeve roll. By using thermo roll types as discussed above the possible breaking of the roll surface common in connection with chill cast rolls when contacting a large amount of cool web or excessive moisture can be avoided.

BRIEF DESCRIPTION OF THE DRAWINGS

In the following the invention is further explained in detail with reference to the accompanying drawings.

DESCRIPTION OF THE PREFERRED EMBODIMENTS

Figure 1A:
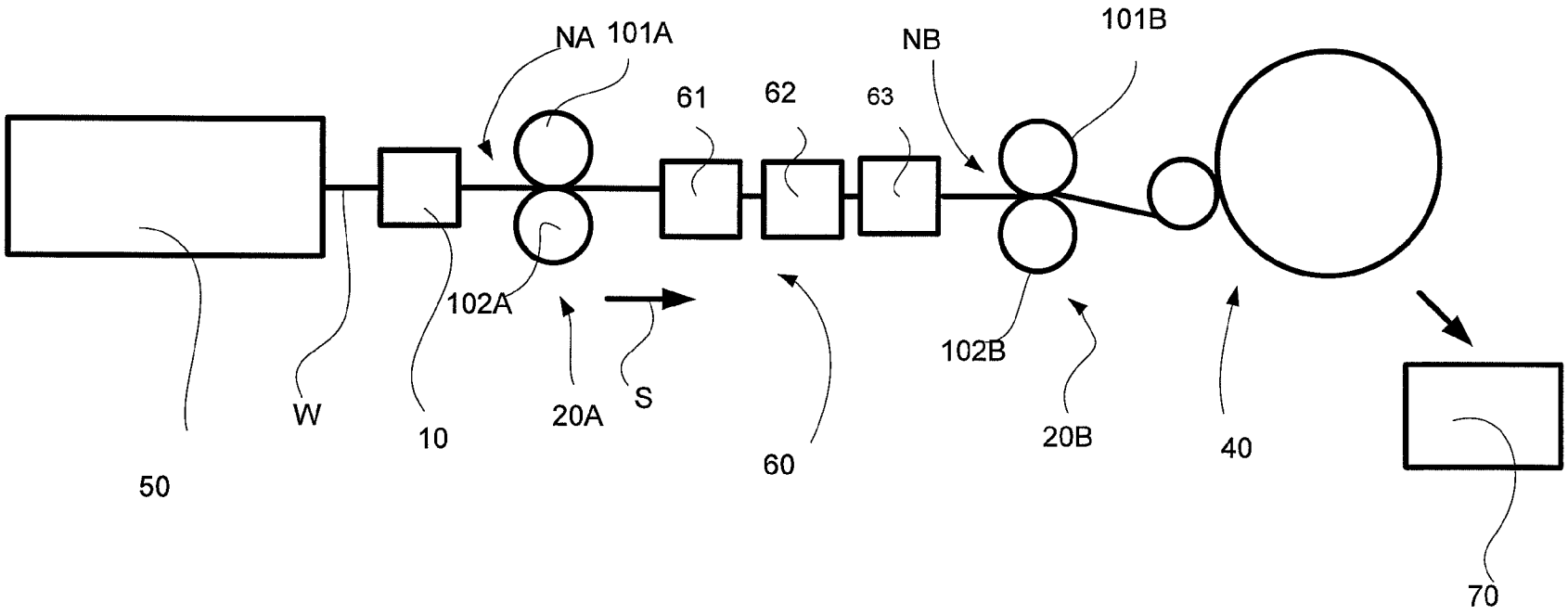
FIG. 1A is a very schematically shown production line for producing coated fiber webs.

In the very schematic example of a production line for producing coated fiber webs, in particular coated board webs shown in FIG. 1A, the beginning sections and parts of the production line have been indicated by reference 50. The beginning sections and devices 50 of the production line for fiber webs W comprise a head box, forming section, press part, drying section and possibly a sizer. These devices and sections can be constructed in various different designs and constructions known as such to one skilled in the art. The production line also comprises a finishing part with finishing sections and devices, which are as such know to one skilled in the art and can be constructed in many various designs and constructions. According to the invention the production line also comprises at least one calender, a calender 20A with at least one calendering nip NA formed between two calendering rolls 101A, 102A and a moisturizing evaporating cooling module 10 comprising cooling and drying gas blowing means with a moisture applicator for providing moisture for vaporization from the fiber web W with latent heat cooling effect. The moisture vaporization is enhanced by the blow or flow created by the cooling means. The moisturizing evaporating cooling module 10 is before the calender 20A. In the example of FIG. 1A there is also a final calender 20B which has at least one calendering nip NB. The calender 20A is a hard nip calender and the final calender 20B can be of any type of a calender, for example a hard nip calender or a soft nip calender or a shoe calender or a metal belt calender or a multinip calender. Advantageously one of the calender rolls 101A, 102A is a heated steel thermo roll or a heated shrink fitted sleeve roll. After the calender 20A a coating section 60 is located. In this example the coating section 60 has three coaters 61, 62, 63. In the running direction of the fiber web the first coater 61 is a blade or a curtain coater and the second coater 62 is a curtain coater and the third coater is a blade coater. The third coater 63 can also be omitted. At the end of the main production line is a reel-up 40 for reeling the fiber web W into a parent roll. The parent rolls are transferred to slitting, winding and packing sections 70 for creating packaged customer rolls by slitting, winding and packaging. The construction of these slitting, winding and packaging sections 70 can be provided in many various designs and constructions as such known to one skilled in the art.

Figure 1B:
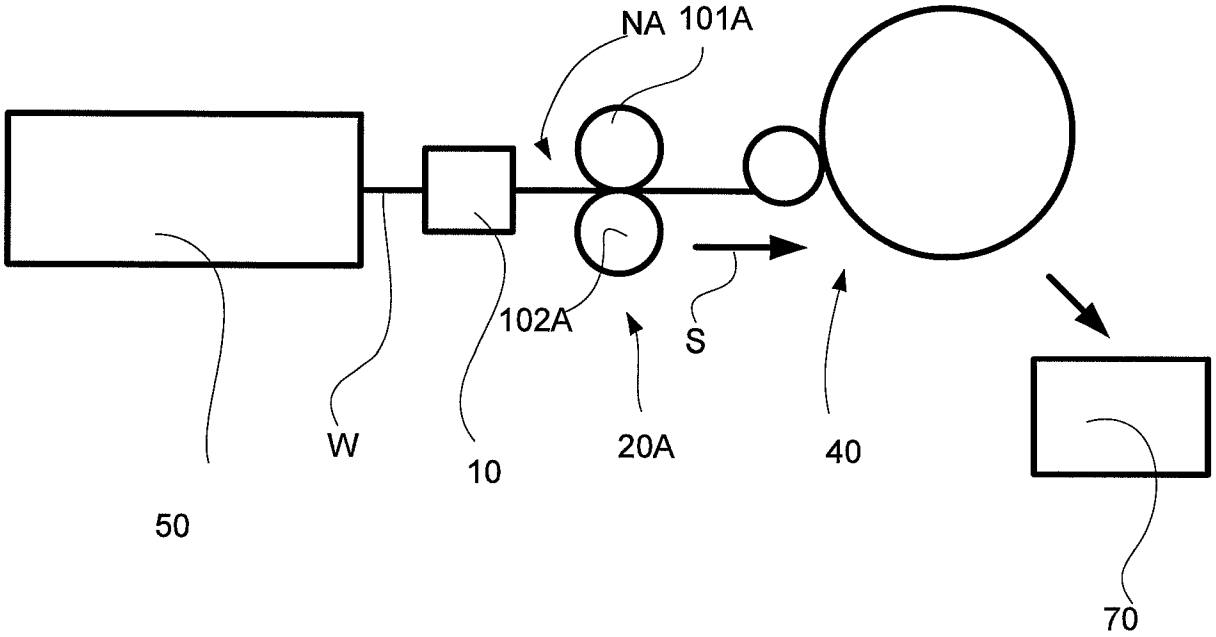
FIG. 1B is a very schematically shown advantageous example of a production line for producing uncoated fiber web according to the invention.

In the very schematic example of a production line for producing uncoated fiber webs, in particular uncoated board webs shown in FIG. 1B the beginning sections and parts of the production line have been indicated by reference 50. The beginning sections and devices 50 of the production line for fiber webs W comprise a head box, forming section, press part, drying section and possibly a sizer. These devices and sections can be constructed in various different designs and constructions known as such to one skilled in the art. The production line also comprises a finishing part with finishing sections and devices, which are as such known to one skilled in the art and can be constructed in many various designs and constructions. According to the invention the production line also comprises at least one calender, a calender 20A with at least one calendering nip NA formed between two calendering rolls 101A, 102A and a moisturizing evaporating cooling module 10 comprising cooling and drying gas blowing means with a moisture applicator for providing moisture vaporization from the fiber web W with latent thermal cooling effect. The moisture vaporization is enhanced by the blow or flow created by the cooling means. The moisturizing evaporating cooling module 10 is before the calender 20A. Advantageously one of the calender rolls 101A, 102A is a heated steel thermo roll or a heated form closure roll. At the end of the main production line is a reel-up 40 for reeling the fiber web W into a parent roll. The parent rolls are transferred to slitting, winding and packing sections 70 for creating packaged customer rolls by slitting, winding and packaging. The construction of these slitting, winding and packaging sections 70 can be provided in many various designs and constructions as such known to one skilled in the art.

Figures 2A, 2B:
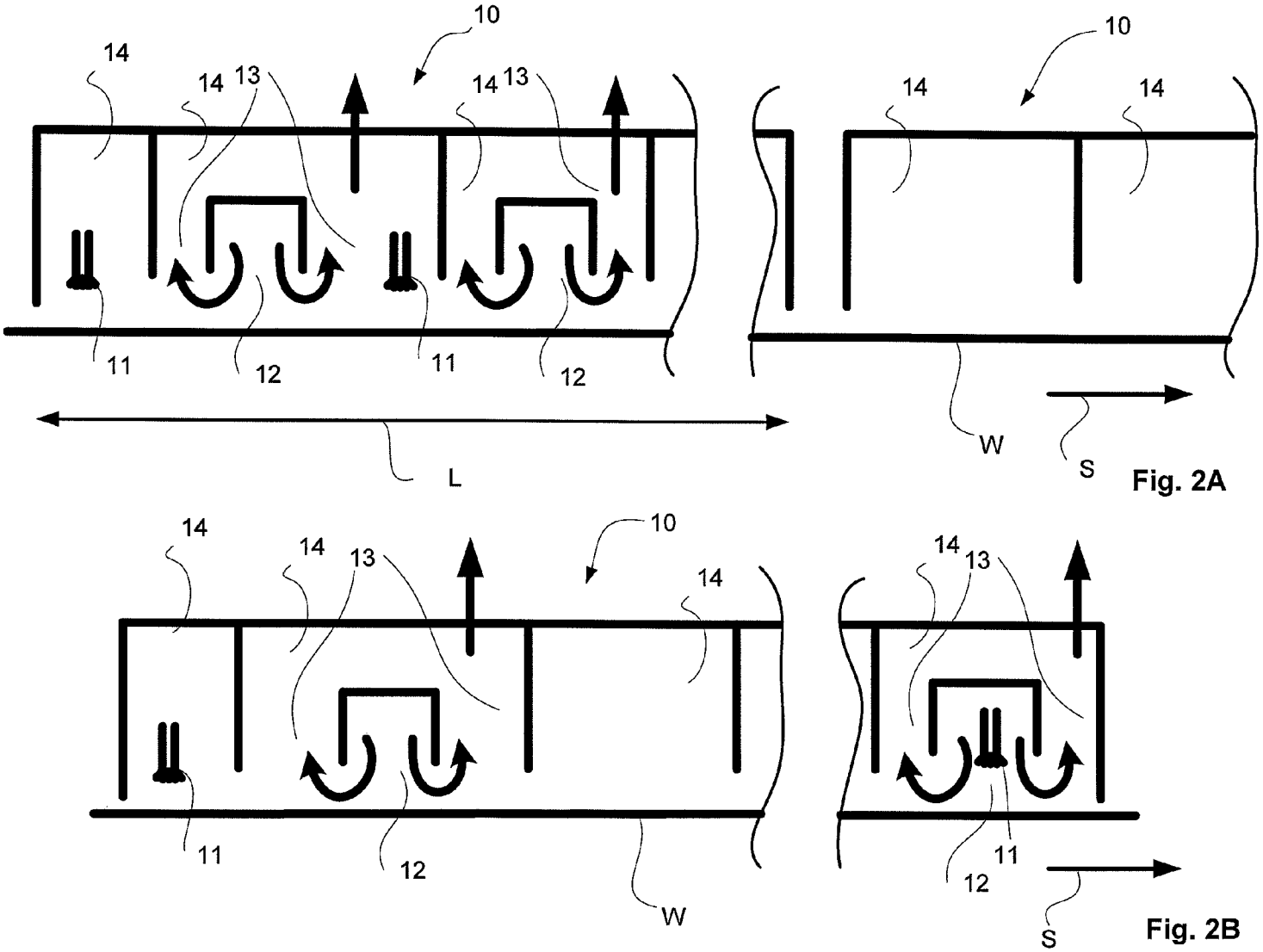
FIG. 2A shows a first example of a moisturizing evaporating cooling module.
FIG. 2B shows a second example of a moisturizing evaporating cooling module.

In FIGS. 2A-2B are shown examples of a moisturizing evaporating cooling module 10, which comprises cross directional liquid nozzle rows 11 for applying liquid, advantageously water, onto the moving fiber web, for example based on pressure atomizing or gas atomizing nozzle technique, cross directional gas nozzle rows 12, for example based on flotation or impingement nozzle technique, for blowing a gas, advantageously air, flow towards the moving fiber web W and cross directional suction openings 13 for removing evaporating substances, advantageously water vapor, moist air, and mist, from the close vicinity of the surface of the moving fiber web W. The moisturizing evaporating cooling module 10 also comprises inlet channels for gas and liquid and outlet channels for removing by the suction opening removed water vapor and moist air. The moisturizing evaporating cooling module also comprises or is connected to actuators, for example blowers or pumps, in order to create inlet flows of the liquid nozzles and of the gas nozzles and to create suction and/or outlet flows of the gas and moisture to be removed. The moisturizing evaporating cooling module 10 has in the running direction S of the fiber web W alternately in cross directional liquid nozzle rows 11 and gas nozzle rows 12 such that liquid and gas is dosed in small dosages alternately so that the liquid on the surface of the fiber web is dried by the gas dosage before the next liquid dosage and thus prevents the liquid to absorb into the fiber web. The moisturizing evaporating cooling module 10 forms one structural unit that is independently mountable and compact. Outer surface length L of the moisturizing evaporating cooling module 10 is 1-6 m in the running direction S of the fiber web W. The moisturizing evaporating cooling module 10 comprises several moisturizing evaporating cooling zones 14 each comprising at least one liquid nozzle row 11 and/or at least one gas nozzle row 12 and optionally at least one cross directional suction opening 13.

Figure 3A:
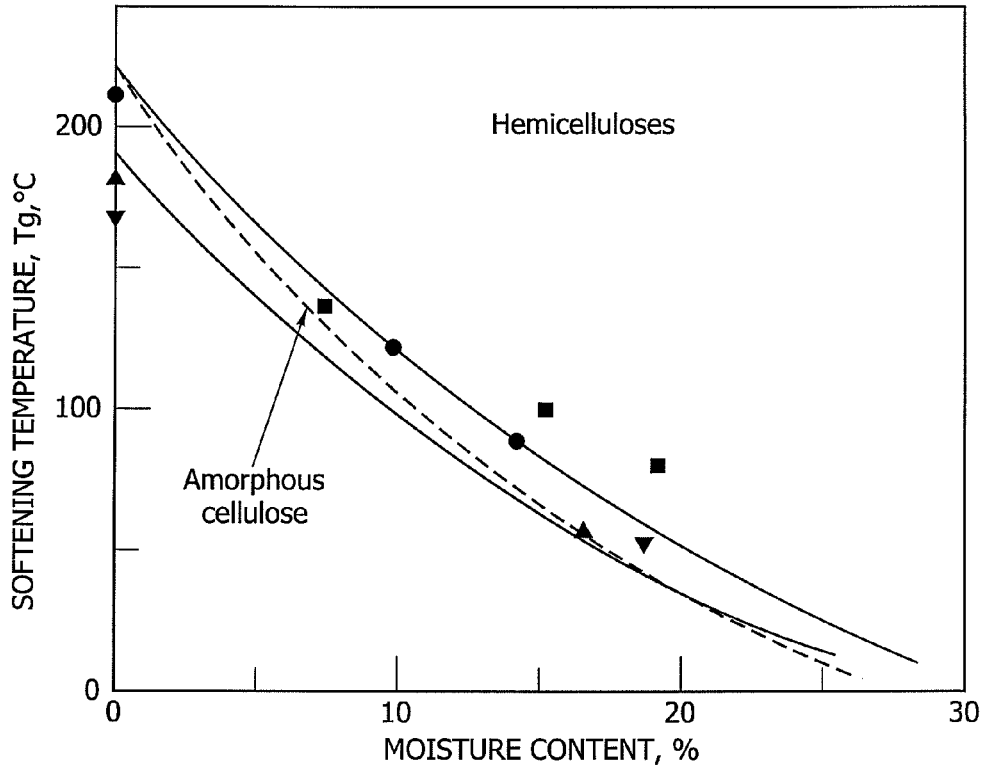
FIG. 3A shows an example of the $T_g$-temperature dependency diagram of hemicellulose.
Figure 3B:
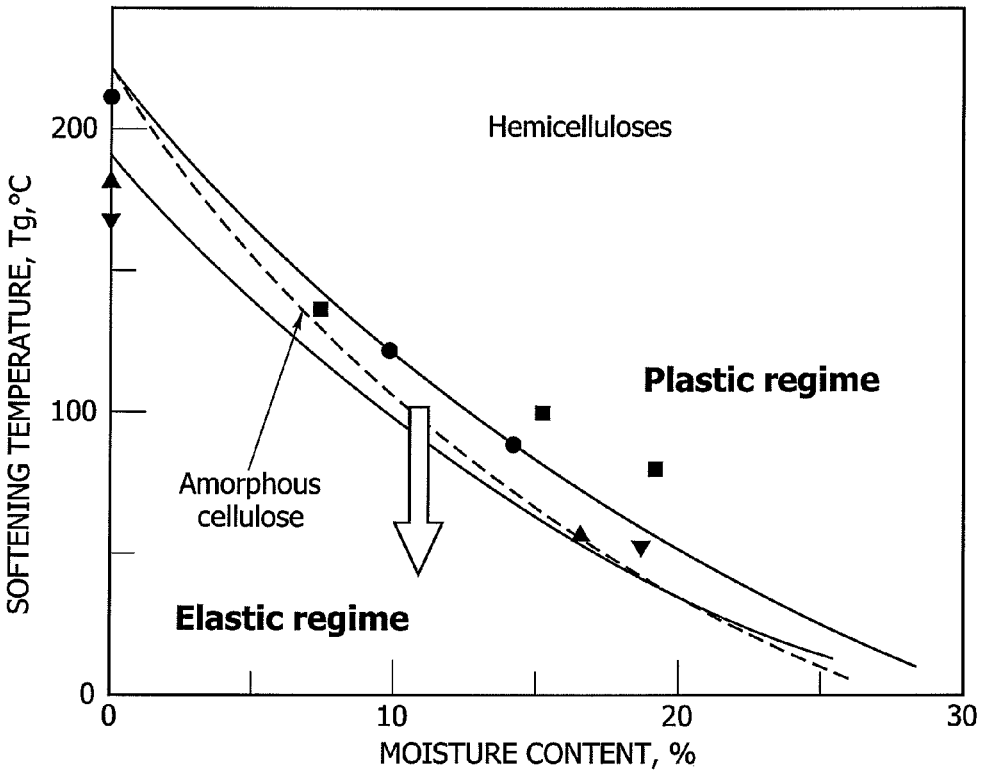
FIG. 3B shown an example of the $T_g$-temperature dependency diagram of hemicellulose of FIG. 3A with an arrow shown cooling of the web, with the plastic and the elastic regimes indicated.

In FIGS. 3A-3B is shown an example of the $T_g$-temperature dependency diagram of hemicellulose. The data points and the fitted curve show the softening temperature of hemicelluloses at different moisture contents. The arrow in FIG. 3B indicates an example of how the temperature of the fiber web is changed due to moisturizing evaporation cooling. The arrow base indicates the temperature after the dryer section before the cooling. If no cooling is performed, the temperature of the middle layer stays practically unchanged at about 100° C. also during calendering and bulk is lost since temperature is near or even above $T_g$ in the whole structure of the fiber web. The arrow head shows the fiber web temperature after the cooling. The fiber web middle layer temperature is reduced down to about 40° C. and the operating point is clearly at elastic regime.

Due to the short dwell time of the calender nip, only the surface layer is heated and the temperature in the middle layers remains low level in the calendering process. The fiber web structure is compacted in the calender nip but is recovering by the spring back effect since web material in the inner structure is at elastic regime. In the following a calculation example of moisturizing evaporating cooling is presented. The specific heat of the fiber web is Cp=1.8 J/(g° C.) and latent heat of evaporation of water h=2250 J/g. In order to cool 250 g/m$^2$ paper by 50° C. requires therefore 1.8 J/(g° C.)×50° C.×250 g/m$^2$/2250 (J/g)=10 g/m$^2$ evaporation of water. In practice, some part of the applied water is lost and not participating to the cooling process, so about 12-16 g/m$^2$ (6-8 g/m$^2$ per each side) water application is required to cool a hot 250 g/m$^2$ fiber web by the anticipated 50° C. This calculation shows that evaporative cooling is reasonable and practical also regarding the amount of applied water. For example, by applying 5-15 g/m$^2$ water on both sides, and letting the water to evaporate in 0.01-5 seconds, possibly by enhancing the evaporation by air blows and ventilation, effective web cooling is achieved also with high weight (100-500 g/m$^2$ and even more) fiber webs using today's typical high production speeds (300-1500 m/min).

We claim:

1. A method for producing a hemicelluloses containing fiber web, comprising the steps of:

forming a paper web in a forming section using a wet process;

drying the fiber web in a dryer section wherein the fiber web leaves the dryer section with the fiber web in a plastic regime of hemicelluloses;

cooling the fiber web in a cooling module by applying liquid to the fiber web with a first cross directional row of liquid nozzles at a first location and drawing air from the fiber web with at least one first cross directional suction opening near the first row of liquid nozzles, followed by blowing gas on to the liquid on the fiber web and evaporating the liquid at a second location spaced from the first location to cool and dry the fiber web, followed by repeating the foregoing steps at least once by applying liquid to the fiber web with a second cross directional row of liquid nozzles at a third location and drawing air from the fiber web with at least one second cross direction opening near the second row of liquid nozzles, followed by blowing gas on to the liquid on the fiber web and evaporating the liquid at a fourth location spaced from the first location to cool and dry the fiber web until the fiber web is cooled to below the plastic regime of hemicelluloses into an elastic regime of the hemicelluloses; and after cooling the fiber web, calendering the fiber web in a hard nip calender with a thermo roll, which has a surface temperature of at least 100° C., such that an outer portion of the fiber web is heated to the plastic regime of hemicelluloses, and an inner portion of the fiber web remains in the elastic regime of the hemicelluloses.

2. The method of claim 1 wherein the step of cooling the fiber web in a cooling module by evaporating the liquid is over a time period of 10-500 ms.

3. The method of claim 1 wherein the liquid is water, and wherein the fiber web has two sides; and wherein the step of cooling the fiber web in a cooling module by cooling the fiber web in a cooling module by applying water to the fiber web with a first cross directional row of water nozzles at a first location and drawing air from the fiber web with openings near the first water nozzles, followed by blowing gas on to the water on the fiber web and evaporating the water at a second location spaced from the first location to cool and dry the fiber web, followed by repeating the foregoing steps at least once by applying water to the fiber web with a second cross directional row of water nozzles at a third location and drawing air from the fiber web with second openings near the second water nozzles, followed by blowing gas on to the water on the fiber web and evaporating the water at a fourth location spaced from the first location to cool and dry the fiber web until the fiber web is cooled to below the plastic regime of hemicelluloses into an elastic regime of the hemicelluloses is applied to both of the two sides of the fiber web.

4. The method of claim 3 wherein the fiber web is a board web, which is cooled by evaporating at least 1-20 g/m$^2$ water per side of each of the two sides of the board web.

5. The method of claim 3 wherein the fiber web is a board web, which is cooled by evaporating at least 1-25 g/m$^2$ water per side of each of the two sides of the board web.

6. The method of claim 3 wherein the fiber web is a board web, which is cooled by evaporating at least 5-20 g/m$^2$ water per side of each of the two sides of the board web.

7. The method of claim 1 wherein the step of cooling the fiber web is by cooling the fiber web in a cooling module and is repeated at least three times, such that liquid and gas are dosed alternately so that the liquid on the surface of the fiber web is dried by the gas dosage before the next liquid dosage and thus preventing the liquid from absorbing into the fiber web while the fiber web is cooled to below the plastic regime of hemicelluloses into the elastic regime of the hemicelluloses.

8. The method of claim 1 wherein temperature of the fiber web is at least 55° C. when the cooling is started.

9. The method of claim 1 wherein moisture content of the fiber web before the cooling by moisturizing evaporating cooling is 5-15% and after addition of moisture and evaporating cooling the moisture content of the fiber web remains in the range of 5-15%.

10. A production line for producing hemicelluloses containing board webs comprising:

a head box;

a wire section after the head box;

a press section after the wire section;

a drying section after the press section;

a cooling module after the drying section, the cooling module having a first cross direction row of liquid applicators arranged to supply liquid to a board web at a first location in the machine direction and at least one first cross directional suction opening arrayed in the cross direction and connected to a source of suction, the first opening positioned near the first row of liquid applicators and positioned near the board web for drawing gases from the board web though the first openings, the first row of liquid applicators followed by a first row of directional gas nozzles directed at the board web and spaced in a machine direction at a second location from the first row of liquid applicators and arranged to blow gas onto the liquid on the board web and evaporate the liquid, a second cross direction row of liquid applicators arranged to supply liquid to the board web at a third location spaced in the machine direction from the first row of gas nozzles and at least one second opening arrayed in the cross direction and connected to the source of suction, the second opening positioned near the second row of liquid applicators, and positioned near the board web for drawing gases from the board web though the second opening, the second row of liquid applicators followed by a second row of directional gas nozzles directed at the board web and spaced in the machine direction from the second row of liquid applicators and arranged to blow gas onto the liquid supplied by the second row of liquid applicators on the board web and evaporate the liquid;

a hard nip calender after the cooling module, the hard nip calender having a thermo roll, which has a surface temperature of at least 100° C.; and a reel-up after the hard nip calender.

11. The production line of claim 10 wherein the liquid applicators are liquid water applicators.

12. The production line of claim 10 wherein the production line further comprises:

a coating section after the hard nip calender and before the reel-up, the coating section comprising a first coating unit and a second coating unit; and a final calender after the coating section and before the reel-up.

13. The production line of claim 10 wherein the production line further comprises:

a coating section after the hard nip calender and before the reel-up, the coating section comprising a first coating unit, which is a blade coating unit or a curtain coating unit; a second coating unit, which is a curtain unit; and a third coating unit which is a blade coating unit; and a final calender after the coating section and before the reel-up.

14. The production line of claim 10 wherein the cooling module is located at a position where a board web leaving the dryer section will have a temperature of at least 55° C.

15. The production line of claim 10 wherein the cooling module comprises at least three cross directional liquid nozzle rows, at least three sets of openings arrayed in the cross direction and connected to a source of suction and at least three cross directional gas nozzle rows.

16. The production line of claim 10 wherein the cooling module comprises at least three cooling zones each comprising a zone having at least one liquid nozzle row, at least one gas nozzle row, and at least one suction opening.

17. The production line of claim 10 wherein the liquid applicators are non-atomizing liquid nozzles.

18. The production line of claim 10 wherein the liquid applicators are atomizing nozzles.

19. The production line of claim 10 wherein the thermo roll is a heated shrink fitted sleeve roll.

* * * * *